United States Patent [19]

Hicks

[11] 3,999,348

[45] Dec. 28, 1976

[54] WATERTIGHT ROOF CONSTRUCTION

[75] Inventor: Clarence R. Hicks, Greenville, Tenn.

[73] Assignee: Ball Corporation, Muncie, Ind.

[22] Filed: Sept. 30, 1975

[21] Appl. No.: 618,121

[52] U.S. Cl. ..... 52/544; 52/545; 52/520

[51] Int. Cl.[2] ..... E04D 1/06; E04D 1/18

[58] Field of Search ..... 52/478, 480, 528, 529, 52/530, 531, 545, 549, 551, 586, 520, 544

[56] References Cited

UNITED STATES PATENTS

| | | | |
|---|---|---|---|
| 511,384 | 12/1893 | White | 52/520 |
| 1,539,632 | 5/1925 | Belding | 52/530 |
| 2,213,519 | 9/1940 | Faber | 52/530 |
| 2,576,296 | 11/1951 | Green | 52/530 |
| 3,438,168 | 4/1969 | Tischuk | 52/545 |
| 3,461,628 | 8/1969 | Wienand | 52/551 |
| 3,469,873 | 9/1969 | Glaros | 52/127 |
| 3,703,062 | 11/1972 | McKinney | 52/545 |
| R24,675 | 7/1959 | Zarnowski | 52/529 |

FOREIGN PATENTS OR APPLICATIONS

| | | | |
|---|---|---|---|
| 384,837 | 2/1965 | Switzerland | 52/529 |

*Primary Examiner*—Price C. Faw, Jr.
*Assistant Examiner*—Henry Raduazo
*Attorney, Agent, or Firm*—Donald R. Cassady

[57] ABSTRACT

A metal covering for a roof deck which comprises a parallel series of roof pans laid substantially horizontally on the deck; said pans containing an upper receiving channel on one face and edge, and a lower receiving channel on the other face and edge, with adjacent pans being connected by a clip consisting of a sheet of metal narrower in width than the roof pan and supported in part thereupon; such clip containing a channel on one edge and a free edge, the channel being retained within the upper receiving channel of the roof pan, and a standoff support consisting a coupling flange portion retained within the combination formed above by the clip channel and the upper receiving channel of the roof pan, a base fastened to the deck, and a substantially vertical member therebetween; the lower receiving channel of the next adjacent roof pan receiving the free edge of the clip.

3 Claims, 2 Drawing Figures

WATERTIGHT ROOF CONSTRUCTION

BACKGROUND OF THE INVENTION

Many methods have been used and still others proposed for covering wooden roof decks by metal sheets, pans, or the like. For example, it is well known to use sheet metal overlaid in a manner similar to the overlaying of wooden or asphalt shingles, nailing the individual sheets under the overlap of the adjacent sheets to lessen water leakage and rusting. Roofs of this type are especially vulnerable to high winds which cause curling of the sheets, exposing the nails to rust and leakage.

To overcome these pitfalls, metal sheeting with various interlocking joint constructions have been proposed. These interlocking constructions include forming adjacent upstanding portions on the edges of sheet metal pans and covering these adjacent upstanding portions with clips or the like to prevent leakage. However, leakage will continue to occur in many of these constructions by capillary action between the closely spaced surfaces of the upstanding portions. This leakage is promoted by the freezing and thawing of the air, water, and water vapor trapped between the layers.

A further defect in the prior art methods has been the use of clips which, when forced over upturned pan edges or flanges or upturned flanges and pins, will cause the pin and pan edges to crush, providing excellent gaps for leakage. Still further defects include the expansion and contraction of clips or the like covering devices loosening the clip which then becomes vulnerable to the wind. The present invention overcomes these defects.

SUMMARY OF THE INVENTION

This invention provides a water tight roof construction for connecting roof pans over a wooden or similarly vulnerable roof deck.

This invention further provides a water tight roof construction for connecting roof panels which are spaced above the roof deck to provide ventilation therebetween.

The contruction herein provided obviates all of the disadvantages hereinbefore disclosed. Further advantages will become obvious to those skilled in the art by a further reading of this description of the invention.

The roof construction of this invention is preferably to be used for roofs of a gentle to moderate slope. In order to prevent leaking, freezing, and similar problems, the roof pans should be placed in substantially horizontal parallel array up the slope of the roof from the eaves to the ridge pole.

The roof cover of this invention comprises roof pans of any convenient length to cover the existing deck. These pans can be preformed at a manufacturing facility or can be shipped as a roll of infinite length of sheet metal and roll formed at the job site. The joint between adjoining pans is formed from channels rolled in the edge of the adjoining pans and two additional sheet metal strips or formed pieces. These pieces are hereinafter described as a clip and a standoff support. The clip and standoff support can be formed from rolls of infinite length and can be coterminous with the sheet metal pans, or can be smaller discrete items of the same cross-sectional form installed in spaced arrangements throughout the length of the seam.

The roof pan is so formed as to contain a channel on the lower face, formed from the lower edge of the pan, and a channel on the upper face, formed from the upper edge of the pan. In forming the roof seam, the lower channel receives the unrolled free edge of the clip, and the upper channel receives the channel of the clip and the coupling flange of the standoff support.

The clip is essentially a single sheet of metal narrower in width than the roof pan and supported, in part, thereupon with one edge formed into a channel, to be retained within the upper channel of the roof pan, and an unrolled edge, to be retained within the lower channel of the next higher roof pan. The clip may be so formed to contain a horizontal offset to ease the formation of the joint between the unrolled edge of the clip, the upper surface of the pan, and the lower roof pan channel of the next higher roof pan. The standoff support comprises a base to be fastened and affixed to the roof deck, a substantially vertical offset member to provide insulation and ventilation between the deck and the roof pan, and a coupling flange to be inserted into the upper channel of the roof pan and the clip channel.

The component pieces of the roof construction of this invention can be made of any metal which is durable under the conditions to which it will be subjected. It will be recognized that certain metals and combination of metals will not be appropriate for such construction because of galvanic currents which can be set up due to salts and acids which leech from the wooden underlay. Of particular value is the construction where standoff support and clip are made of galvanized iron and all other components are made of zinc.

DETAILED DESCRIPTION OF THE DRAWINGS

In order to more clearly disclose the construction, operation, and use of the invention, reference should be made to the accompanying drawings forming part of the invention. Throughout the several views in the drawings, like reference characters designate the same parts.

Figure 1:
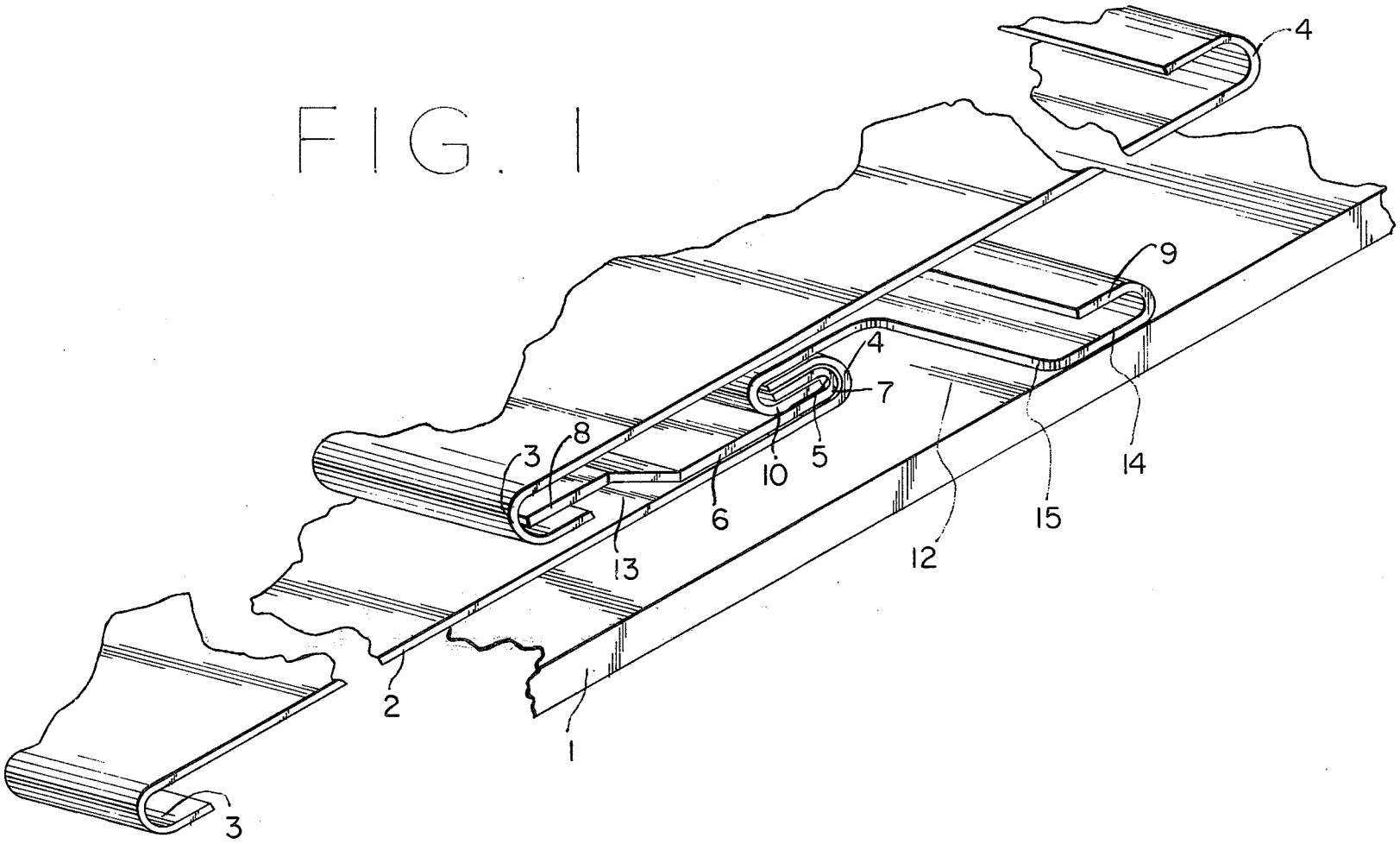
FIG. 1 shows the completed roof seam.
Figure 2:
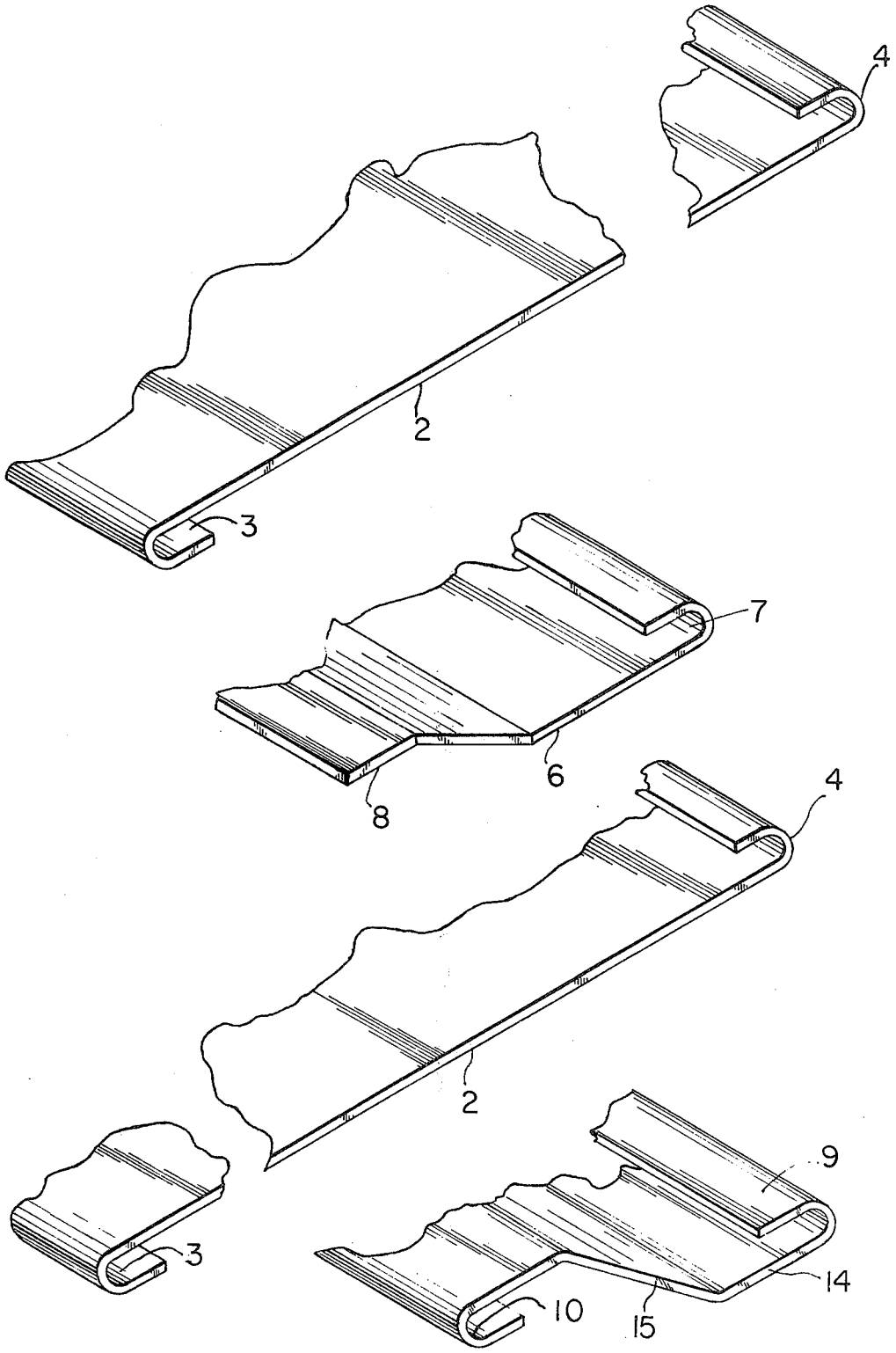
FIG. 2 shows the components of the roof seam prior to assembly.

In FIG. 1, an existing roof pan 2 (in this case shown partly broken away and not incorporated into a prior joint) is shown in place over an existing deck 1. The opposite edges of the roof pan are so formed as to provide a receiving channel on each side labelled hereinafter as the lower channel 3 or clip receiving channel and the upper channel 4 or standoff support receiving channel. Since, in its preferred method of use, the roof is intended to be laid substantially horizontally on a gently sloping deck, the channels are so arranged that the lower channel 3 is downstream of the upper channel 4. In this manner, rain and snow will not be trapped in the formed joints and runoff will not be impeded.

Clip 6 is so formed to contain a standoff receiving channel 7 having a curvature approximating that of the standoff receiving channel 4 of the existing roof pan 2. The combination of the standoff support receiving channel 4 of the roof pan 2 and the standoff support receiving channel 7 of the clip 6 forms the female portion of the joint which is completed by the insertion of a coupling flange portion 10 of the standoff support 9 into space 5. The base 14 of the support 9 is firmly fastened to the deck with cleats, nails, or screws, or the like and is so formed that an offset member 15 provides an air space 12 between the deck and the roof pan for insulation and ventilation purposes.

Clip 6 now provides a free edge 8 for insertion into the clip receiving channel 3 of a new roof pan 2 and the cycle is repeated. Preferably, as shown in the drawing, clip 6 is slightly offset at 11 to provide space 13 for easier insertion of the edge 8 into the roof pan clip receiving channel 3.

The method of building up a roof by the method of this invention is substantially as follows:

Existing roof pan 2, previously firmly attached to the deck, provides for a standoff support receiving channel 4 on the upper surface. Then, standoff support receiving channel 7 of clip 6 is inserted into this existing roof pan standoff support receiving channel 4, and the combination is locked by the insertion of the coupling flange portion 10 of the standoff support 9. The standoff support is then firmly affixed to the deck. The clip edge 11 is then available for the insertion into the clip receiving channel 3 of a new roof pan 2.

I claim:

1. A metal covering for a roof deck which comprises:

1. a parallel series of roof pans spaced substantially horizontally above the deck; said pans containing an upper receiving channel on one edge, and a lower receiving channel on the opposing edge, with adjacent pans being connected by;
2. a clip consisting of a sheet of metal narrower in width than the roof pan and supported in part thereupon, such clip containing a channel on one edge and a free edge, the channel being retained within the upper receiving channel of one roof pan and the free edge engaging the lower receiving channel of the adjacent roof pan; and
3. a standoff support consisting of a coupling flange portion retained within the combination formed by the clip channel and the upper receiving channel of the roof pan, a base fastened to the deck, and an offset member therebetween to provide air space between the deck and the roof pan.

2. The roof deck of claim 1, wherein the clip is substantially coterminous with the roof pan.

3. The roof pan of claim 1, wherein the clip is a small discrete item installed in spaced arrangement throughout the length of the seam.

* * * * *